US008021208B2

(12) United States Patent
Victor

(10) Patent No.: US 8,021,208 B2
(45) Date of Patent: Sep. 20, 2011

(54) MAGAZINE WITH CONSTANT-FORCE SPRING FOR DISPENSING ELASTOMERIC FOAM PROJECTILES

(76) Inventor: Robert J. Victor, Sunnyside, NY (US)

( * ) Notice: Subject to any disclaimer, the term of this patent is extended or adjusted under 35 U.S.C. 154(b) by 352 days.

(21) Appl. No.: 12/400,871

(22) Filed: Mar. 10, 2009

(65) Prior Publication Data

US 2009/0229158 A1 Sep. 17, 2009

Related U.S. Application Data

(60) Provisional application No. 61/035,392, filed on Mar. 11, 2008.

(51) Int. Cl.
*A63H 33/30* (2006.01)
*F41A 9/61* (2006.01)

(52) U.S. Cl. ..... 446/473; 124/45; 124/47

(58) Field of Classification Search ..... 446/473; 124/16–29, 45, 47; 42/7–6, 49.1, 49.01, 42/50

See application file for complete search history.

(56) References Cited

U.S. PATENT DOCUMENTS

| | | | | |
|---|---|---|---|---|
| 2,777,235 | A | 3/1953 | Hopkins | |
| 3,959,189 | A * | 5/1976 | Kitamori | 521/59 |
| 4,888,899 | A | 12/1989 | Chesnut et al. | |
| 5,099,595 | A | 3/1992 | Chesnut et al. | |
| 5,611,322 | A * | 3/1997 | Matsuzaki et al. | 124/6 |
| 5,634,564 | A | 6/1997 | Spamer et al. | |
| 2002/0166551 | A1 * | 11/2002 | Lee | 124/78 |
| 2006/0100296 | A1 * | 5/2006 | Wilkes et al. | 521/134 |

* cited by examiner

*Primary Examiner* — Dmitry Suhol
*Assistant Examiner* — Alex F. R. P. Rada, II
(74) *Attorney, Agent, or Firm* — Peter J. Rashid

(57) ABSTRACT

A magazine for a toy gun includes a housing, at least one projectile disposed within the housing, and a constant-force spring disposed within the housing for providing a biasing force against the at least one projectile. The at least one projectile is made of elastomer or polymer foam material having a density between about 0.020 g/cm$^3$ (1.25 lbs/ft$^3$) and about 0.833 g/cm$^3$ (52 lbs/ft$^3$), and a 25% compression resistance (compression deflection) between about 0.6 psi and about 20 psi. The magazine is capable of holding and dispensing the projectiles such that the biasing force of the constant-force spring does not excessively deform the projectiles.

4 Claims, 3 Drawing Sheets

MAGAZINE WITH CONSTANT-FORCE SPRING FOR DISPENSING ELASTOMERIC FOAM PROJECTILES

BACKGROUND OF THE INVENTION

This invention relates to a magazine or chamber for holding and dispensing multiple projectiles, and in particular, to a magazine that a constant-force spring, also known as a negator coil spring, to hold and dispense elastomeric foam projectiles within the magazine.

There have been multiple attempts to create ammunition magazines to store and dispense elastomeric foam projectiles using spring-power. These magazines have used conventional spring configurations, such as compression springs and torsion springs, to achieve the relatively long action required by this type of application. However, such conventional springs all share the undesirable characteristic that their restoring force is proportional to their deflection length. In other words, the further these springs are compressed, the more forcefully they push back. When a magazine using this type of spring is used to dispense relatively soft, elastomeric foam projectiles, this characteristic of conventional springs results in excessive deformation of the projectiles, particularly as multiple projectiles are added to the magazine and the spring becomes highly compressed. This effect currently limits the practical capacity of current magazines for loading elastomeric-foam projectiles to approximately seven projectiles. Therefore, it would be desirable to increase the capacity for magazines that use elastomeric foam projectiles.

BRIEF SUMMARY OF THE INVENTION

Briefly, according to an aspect of the invention, there is provided a magazine for a toy gun comprising a housing; at least one projectile disposed within the housing, the at least one projectile made of elastomer or polymer foam material having a density between about 0.020 g/cm$^3$ (1.25 lbs/ft$^3$) and about 0.833 g/cm$^3$ (52 lbs/ft$^3$), and a 25% compression resistance (compression deflection) between about 0.6 psi and about 20 psi; and a constant-force spring disposed within the housing, the constant-force spring providing a biasing force against the at least one projectile. The magazine is capable of loading the projectiles such that a biasing force of the constant-force spring does not exceed the 25% compression resistance of the projectiles.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
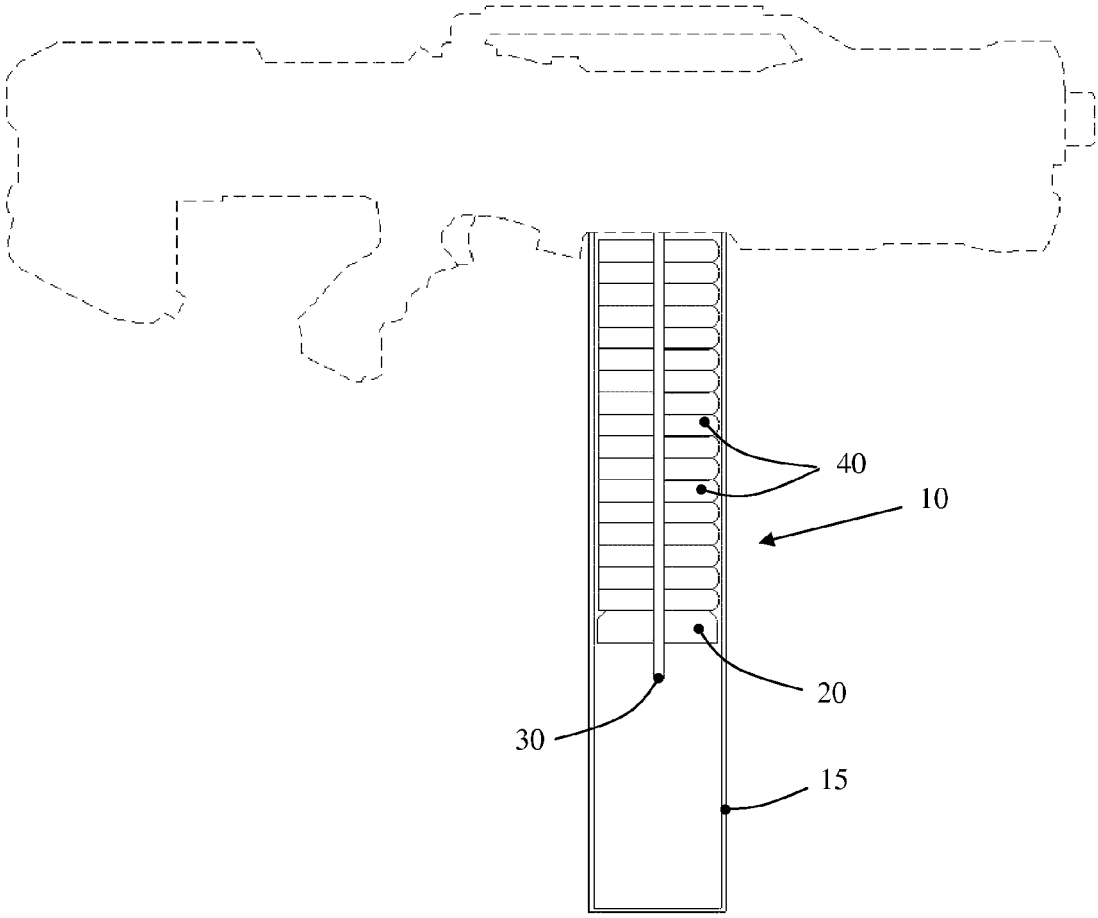
FIG. 1 is a side view of a magazine for a toy gun (shown in phantom) according to an embodiment of the invention.
Figure 2:
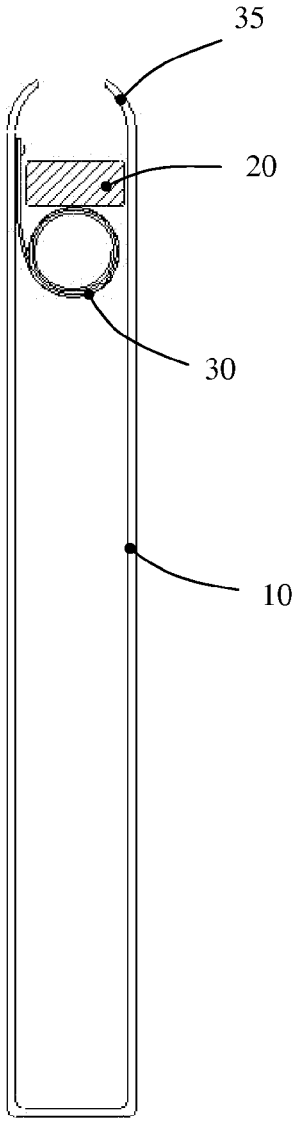
FIG. 2 is a cross-section view of the magazine of FIG. 1 that is empty of projectiles.
Figure 3:
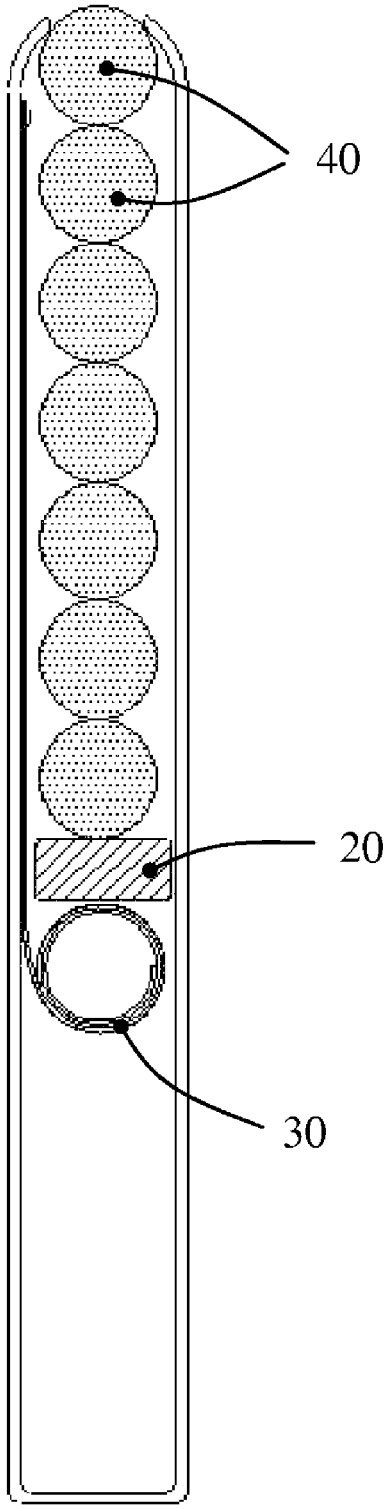
FIG. 3 is a cross-sectional view of the magazine of FIG. 1 when loaded with projectiles.

Referring now to FIGS. 1-3, a magazine, shown generally at 10, for retaining and dispensing projectiles 40 is shown according to an embodiment of the invention. In the embodiment, the projectiles 40 comprise elastomeric foam projectiles. The magazine 10 includes a magazine housing 15, a pusher platform 20, and a spring 30. The magazine housing 10 may further include a step feature 35 at one end of the magazine 10 to prevent unwanted ejection of the projectiles 40 from the magazine 10. It will be appreciated that neither the pusher platform 20, nor the step feature 35 are essential to the function of the invention.

As used herein, density is given in terms of grams/cubic centimeter or lbs/cubic foot, and compression resistance or compression deflection is given as the pressure (in pounds per square inch) needed to compress the material by 25% of it's thickness.

The projectiles 40 used in the magazine 10 of the invention are made of elastomer or polymer foam material having a density in a range between about 0.020 g/cm$^3$ (1.25 lbs/ft$^3$) and about 0.833 g/cm$^3$ (52 lbs/ft$^3$), and preferably about 0.0382 grams/cubic centimeter (2.38 lbs/cubic foot). The compression resistance of the projectiles 40 is in the range between about 2 psi to about 5 psi, and a 25% compression resistance (compression deflection) between about 0.6 psi and about 20 psi.

Figure 4:
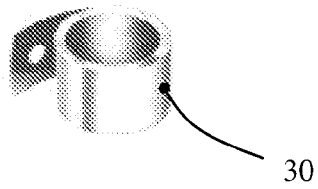
FIG. 4 is a perspective view of a constant-force spring used in the magazine according to an embodiment of the invention.
Figure 5:
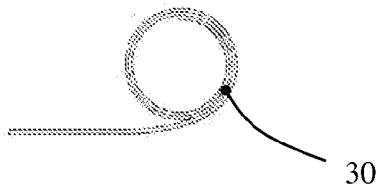
FIG. 5 is a cross-sectional view of the constant-force spring of FIG. 4.

Referring now to FIGS. 4 and 5, the spring 30 comprises a constant-force spring consisting of a flat strip of flexible material arranged in a scroll configuration. The spring 30 has the unique property of maintaining a substantially constant biasing force against the projectiles 40 as the spring 30 is unrolled.

During use, the projectiles 40 are loaded sequentially into the magazine 10, thereby extending the spring 30, as shown in FIGS. 1 and 3. Because the spring 30 comprises a constant-force spring, the biasing force against the projectiles 40 remains substantially constant, thereby allowing the user to load as many projectiles 40 as possible into the magazine 10, with the only limitation being the capacity of the magazine 10.

Testing of the magazine 10 with the constant-force spring 30 has produced the unexpected results that the magazine 10 has a capacity of at least forty projectiles without noticeable deformation of the projectiles 40. In principle, even higher capacities are achievable, and are limited only by the practical length of the device.

As described above, the magazine 10 of the invention holds and dispenses elastomeric foam projectiles in such a way that the advancing-force within the magazine 10 remains substantially constant, regardless of the number of projectiles within the magazine 10. As a result, the magazine 10 is capable of loading the projectiles 40 such that the biasing force of the constant-force spring 30 does not excessively deform them. Excessive deformation is defined as compressive deformation sufficient to expand the projectiles laterally so that they simultaneously press against both of the inner walls of the magazine 10.

It will be appreciated that this compression-effect is self-reinforcing, in the sense that when a projectile 40 is compressed sufficiently to contact both inner walls of the magazine 10, the sliding friction between this projectile and the walls of the magazine increases. As a consequence, an even greater compressive force is required to produce further downward motion of the projectile 40. However, this increased compressive force further expands the projectile 40 against the housing walls, thereby further increasing the compressive force required to cause additional downward motion. When this effect is multiplied over several darts, the advantages of the present invention become apparent.

The documents, patents and patent applications referred to herein are hereby incorporated by reference.

While the invention has been specifically described in connection with certain specific embodiments thereof, it is to be understood that this is by way of illustration and not of limitation, and the scope of the appended claims should be construed as broadly as the prior art will permit.

What is claimed is:

1. A magazine for a toy gun, comprising:

a housing;

at least one projectile disposed within the housing, the at least one projectile made of elastomer or polymer foam material having a density between about 0.020 g/cm$^3$ (1.25 lbs/ft$^3$) and about 0.833 g/cm$^3$ (52 lbs/ft$^3$), and a 25% compression resistance (compression deflection) between about 0.6 psi and about 20 psi; and a constant-force spring disposed within the housing, the constant-force spring providing a substantially constant biasing force against the at least one projectile.

2. The magazine according to claim 1, further comprising a pusher platform disposed between the at least one projectile and the constant-force spring.

3. The magazine according to claim 1, further comprising a step feature at one end of the magazine for preventing unwanted ejection of the at least one projectile from the magazine.

4. The magazine according to claim 1, wherein the constant-force spring comprises a flat strip of flexible material arranged in a scroll configuration.

* * * * *